United States Patent [19]

Viertola

[11] Patent Number: 4,955,809

[45] Date of Patent: Sep. 11, 1990

[54] LINING ELEMENT AND STRUCTURE FOR HEAT TREATMENT FURNACES

[76] Inventor: Raimo Viertola, Väinämöisenkatu 34 B, SF-33540 Tampere, Finland

[21] Appl. No.: 306,019

[22] PCT Filed: May 25, 1988

[86] PCT No.: PCT/FI88/00080

§ 371 Date: Jan. 26, 1989

§ 102(e) Date: Jan. 26, 1989

[87] PCT Pub. No.: WO88/09472

PCT Pub. Date: Dec. 1, 1988

[30] Foreign Application Priority Data

May 26, 1987 [FI] Finland ..... 872317

[51] Int. Cl.[5] ..... F27D 1/00

[52] U.S. Cl. ..... 432/247; 110/332; 110/336; 110/340; 432/250

[58] Field of Search ..... 110/336, 332, 340; 432/248, 247, 250; 52/404

[56] References Cited

U.S. PATENT DOCUMENTS 3,302,356 2/1967 Hinchliffe .
3,854,262 12/1974 Brady ..... 110/336
4,381,634 5/1983 Hounsel et al. ..... 52/404
4,449,345 5/1984 Hounsel et al. ..... 110/336
4,494,295 1/1985 Herring ..... 52/404
4,516,374 5/1985 Finney .
4,523,531 6/1985 Bishara ..... 110/336
4,549,382 10/1985 Byrd, Jr. .
4,721,461 1/1988 Falk ..... 432/247
4,803,822 2/1989 Deren ..... 110/336

FOREIGN PATENT DOCUMENTS 2709958 3/1978 Fed. Rep. of Germany .

*Primary Examiner*—Henry C. Yuen
*Attorney, Agent, or Firm*—Pollock, Vande Sande & Priddy

[57] ABSTRACT

A lining element for heat treatment furnaces comprises lining material consisting of insulating material, an elongate supporting element for transversely piercing the lining material, and elongate fastening members for attachment of the element to the interior furnace wall provided at both ends of the supporting element. The free ends of the fastening members are provided with projections extending transversely to the longitudinal direction of the fastening members at the height of a planar interior surface of the element, which surface will be closest to the interior furnace wall.

12 Claims, 5 Drawing Sheets

LINING ELEMENT AND STRUCTURE FOR HEAT TREATMENT FURNACES

BACKGROUND OF THE INVENTION

This invention relates to a lining element for heat treatment furnaces. This invention relates also to a lining structure containing lining elements.

It is a known practice to provide lining structures which are used for thermal insulation purposes in industrial heat treatment furnaces. These structures are fastened to the interior wall of the furnace and in their innermost layer, that is the layer closest to the interior of the furnace, the fibers are mainly directed parallel to planes which are perpendicular to the interior furnace wall. The elements, which are installed at the layer, consist of fibrous plates disposed one after the other and situated perpendicularly to the interior furnace wall The plates are pierced by means of supporting a element, with which the lining element is fastened to the furnace. This ensures, that the fibers will not become easily detached from the lining. Moreover, the supporting elements serving as the fastening means, are situated within the fibers and they are not exposed to deteriorative circumstances within the furnace. Between the element and the interior furnace wall, a layer can be provided, which contains less expensive and thermally less resistant fibers, such as ceramic fibers or mineral wool.

The structure described hereinabove is disclosed by DE-OS No. 35 33 982. The elements shown by this publication comprise a supporting element piercing the insulating material consisting of ceramic fibers, and a plate welded to one end of the supporting element and provided with a flange. The element can be secured to the interior furnace wall or to a support projecting from the interior furnace wall by means of screws at the location of the flange. The said plate is also provided with a hole, into which the end of the supporting element in the next element can be inserted when the element is mounted at its place. The structure of these elements has some disadvantages, which makes their use and installation cumbersome. The free end of the supporting element piercing the insulating material does not very firmly hold the fibrous plates in their places, for example, during the transport of the elements. For this purpose a stopper must be provided, which causes difficulties when mounting the elements. Further, the fastening plate at the other end of the supporting element is inconvenient, because attaching it by means of screws to the interior furnace wall or to a specific fixing means provided thereon is time-consuming and difficult.

SUMMARY OF THE INVENTION

The present invention makes it possible to eliminate the above discussed disadvantages due to the structure of the lining element in accordance with the invention is mainly characterised by the features. Present invention means at both ends of the supporting lining element piercing the insulating material, and these means extend transversely in relation to the supporting element. Using these fastening means, the elements can be secured at the ends of the fastening means onto the interior furnace wall in a single operational stage. In case the insulating material is formed of fibrous plates, the fibrous plates are firmly held in the element as the fastening means compress them therebetween and the element can be fastened at the wall.

The ends of the fastening means can be, for example, shaped so that they can be pushed in a single motion into the supporting means provided on the interior furnace wall.

The lining structure in accordance with the invention, eliminating the previously discussed disadvantages of the lining elements of the prior art, are characterised by the features disclosed in art includes the projections at the ends of the fastening means of the elements and the fastening means projecting from the interior furnace wall and being suitably shaped, such as to facilitate installation work.

The invention will be explained in more detail in the following description, where reference is made to the appended drawings, wherein

DETAILED DESCRIPTION OF THE PREFERRED EMBODIMENT(S)

Figure 1:
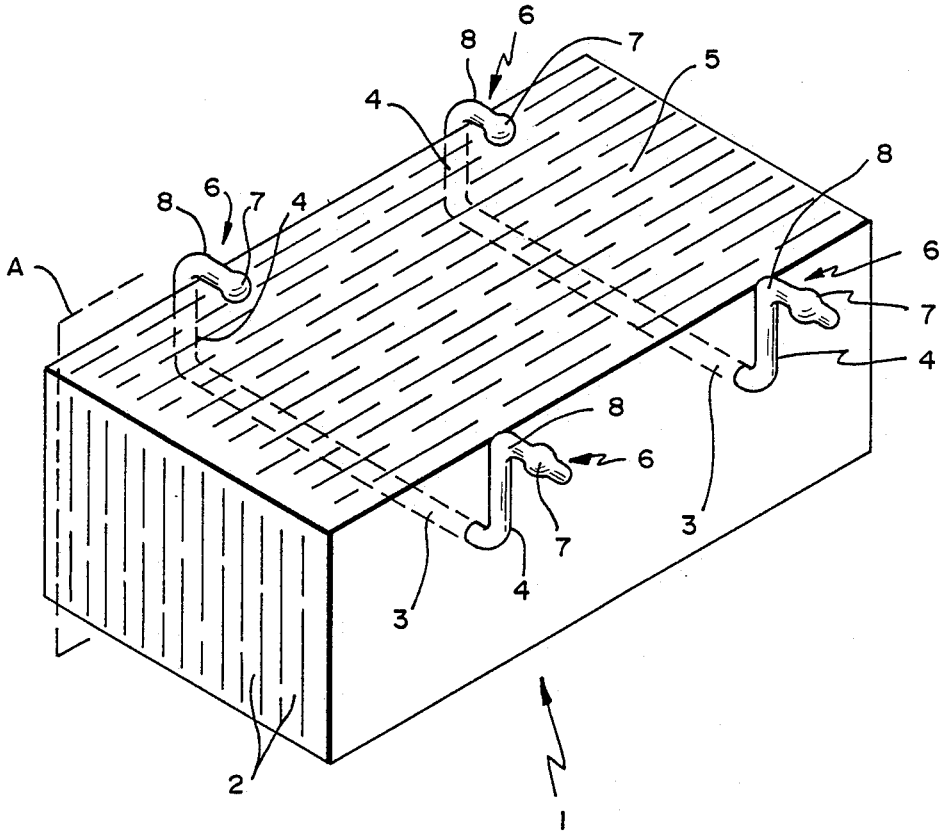
FIG. 1 is a perspective view of the lining element in accordance with the present invention.

FIG. 1 shows a lining element 1 in accordance with the present invention. The lining element has the shape of a rectangular prism and the lining material therein comprises fibrous plates 2 consisting of ceramic fibers. In the fibrous plates the fibers extend mainly parallelly to the plane of the plates (broken line A). The plates are pierced perpendicularly thereto by two rod-like supporting elements 3 such that they, at the location of each plate, pass through the uniform lining material within the plate. Both ends of the supporting elements are bent transversely in relation to the longitudinal direction of the supporting elements to extend parallelly to the plates, in other words parallelly to the end sides of the elements, at both end sides of the elements. The bent portions 4 are directed towards a surface 5 perpendicular to the element plates and at the same time to the plane of the fibers, in other words perpendicular to the end sides of the elements. This surface will be situated closest to the interior furnace wall substantially in a parallel relationship thereto. The bent portions also keep the element together by compressing the fibrous plates 2 therebetween. Also, use can be made of such elements where the lining material is not formed of plates, but forms a uniform piece having the shape of a rectangular prism with randomly oriented fibers therein. Also, the supporting elements pass through a uniform lining material in these kinds of elements.

Instead of fibers, also other kinds of insulating material can be used. From the operational point of view, the system is advantageous, because insulating material is loose, that is, it can be slightly compressed.

The bent portions 4 serve as fastening means for fastening the element onto the interior wall of the furnace. The means extend at the height of the surface 5 and at this location they are bent at their free ends to a position, where they are parallel to the surface 5. In this way projections are formed, which project perpendicularly from the elongate fastening means 4 and by means of which the element can be fastened into supporting means, which will be described hereinafter. In both supporting elements 3 of the element shown by FIG. 1, the projections 6 of the opposite ends are directed towards the same direction, which allows the pushing of the element into the supporting means in the direction of the projections. This function will also be explained hereinafter in more detail.

Figure 2:
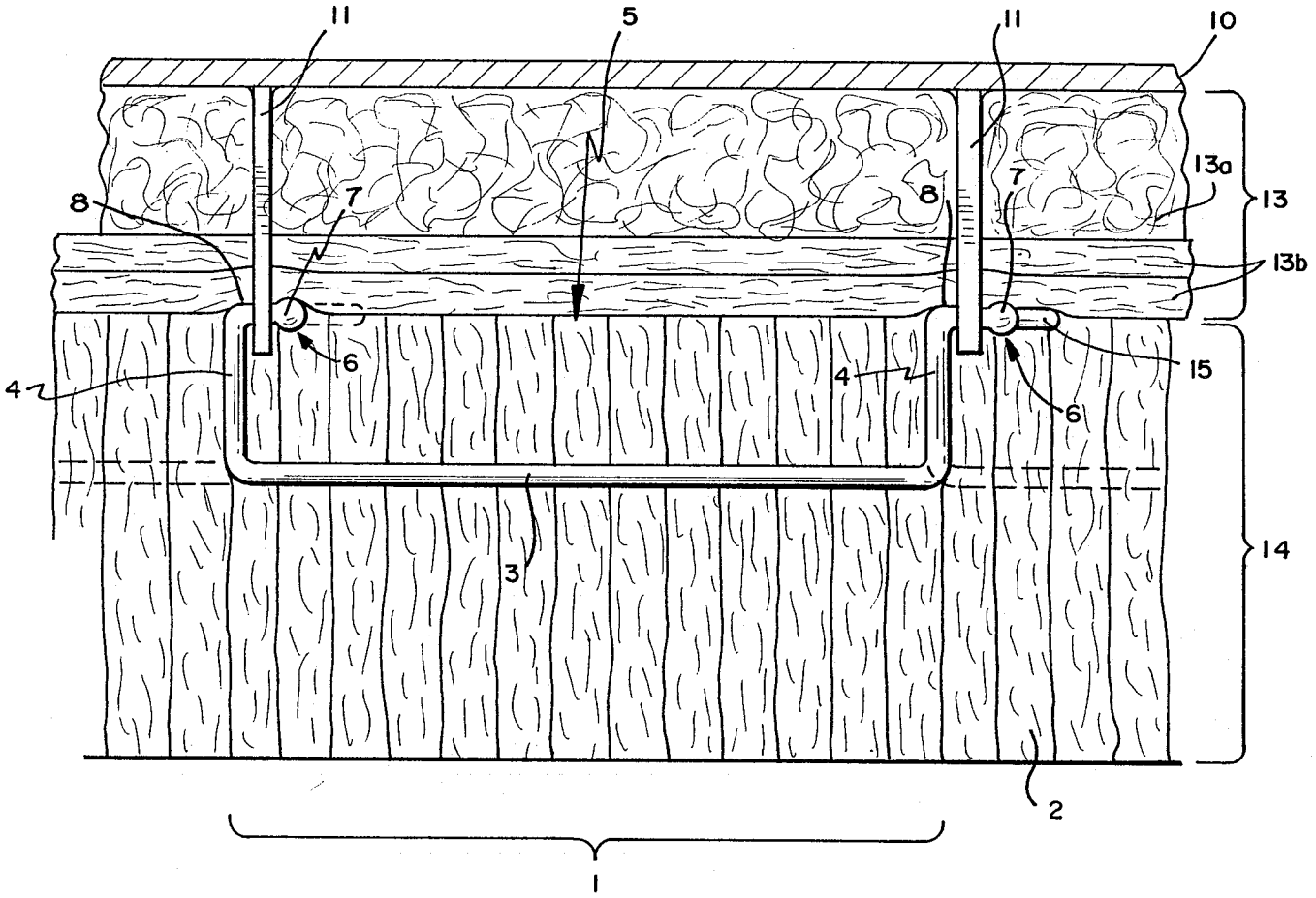
FIG. 2 is a sectional view of the lining structure in accordance with the invention, taken perpendicularly to the interior furnace wall.

FIG. 2 illustrates the positioning of the element 1 according to the invention in the lining structure, seen as a longitudinal section taken perpendicularly to the fibrous plates 2 along the supporting element 3. The lining structure comprises a two-part lining layer 13 closest to the interior wall 10 of the furnace, this layer comprising a mineral wool layer **13*a* placed against the wall 10 and thereon a layer 13*b* consisting of plates of ceramic fibers. In the latter layer the plates and the fibers are parallel to the wall 10. The layer closest to the wall is usually made of less expensive and less thermally resistant material, and the corresponding properties in this layer appear further so, that the mineral wool layer 13*a* closest to the wall has the lowest thermal resistance of all, being at the same time least expensive. In this way the heat insulating properties of the furnace can be optimized. The lining layer 14 closest to the circumstances within the interior of the furnace is formed of the lining elements 1 of the present invention. For fastening the lining element, plate-like supporting means 11 are welded onto the interior furnace wall at regular distances from each other. The supporting means 11 project perpendicularly from the interior furnace wall. The elements 1 are fastened by inserting the projections 6 through holes in the supporting means 11. The insertion takes place in a direction perpendicular to the fibrous plates 12. In case of the ceiling of the furnace, as in FIG. 2, the elements are held fastened in the structure due to the fact that the supporting element 3 and the fastening means at the ends thereof act as a hanging means. The structure is tight, because on one hand the fibrous plates 2 are compressed in the element between the fastening means 4 extending parallelly thereto, and on the other hand the layer 13 on the side of the wall elastically presses the element 1** in the direction away from the wall. In this way the different fibrous layers are compressed tightly against each other and consequently, no seams giving rise to heat leakages can appear.

Figure 4:
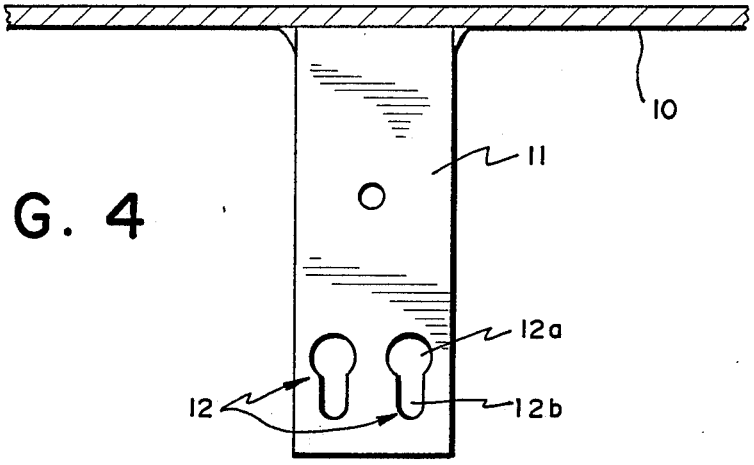
FIG. 4 is a view of the supporting means of the lining structure.

FIGS. 2 and 4 illustrate the fastening principle in more detail. The projections 6 at both ends of the fastening means 4 comprise a portion 7 being larger in cross-section and being located at a distance from the point, where the projection 6 is bent to project from the fastening means 4. The portion 7 acts as a stopping means and in cooperation with the opening of the supporting means 11 shown in FIG. 4 it prevents the longitudinal movement of the supporting element 3 and its fastening means and at the same time it prevents the movement and possible detachment of the whole element 1. The opening 12 in the supporting means comprises a portion **12*a*, which is dimensioned so, that the stopping means 7 has space to pass it when the projection 6 is inserted into the opening. A notch 12*b* joins to the edge of the portion 12*a* on the side of the element 1 and this notch accommodates a narrower portion 8 located between the stopping means 7 and the fastening means 4. When the projection is inserted to the extent that the portion 8 is situated at the location of the plate 11, the projection is caused to move towards the notch 12*b*, whereby the portion 8 will be accommodated within the notch and the moving of the projection back towards the direction opposite to the insertion direction will be prevented, because the notch 12*b* is narrower than the stopping means. Further, the lining layers 13 on the side of the wall 10 press the projection towards of the notch 12*b***, thus locking the fastening means in their places in these directions. The structure is therefore also operative on the side walls of the furnace.

Figure 3:
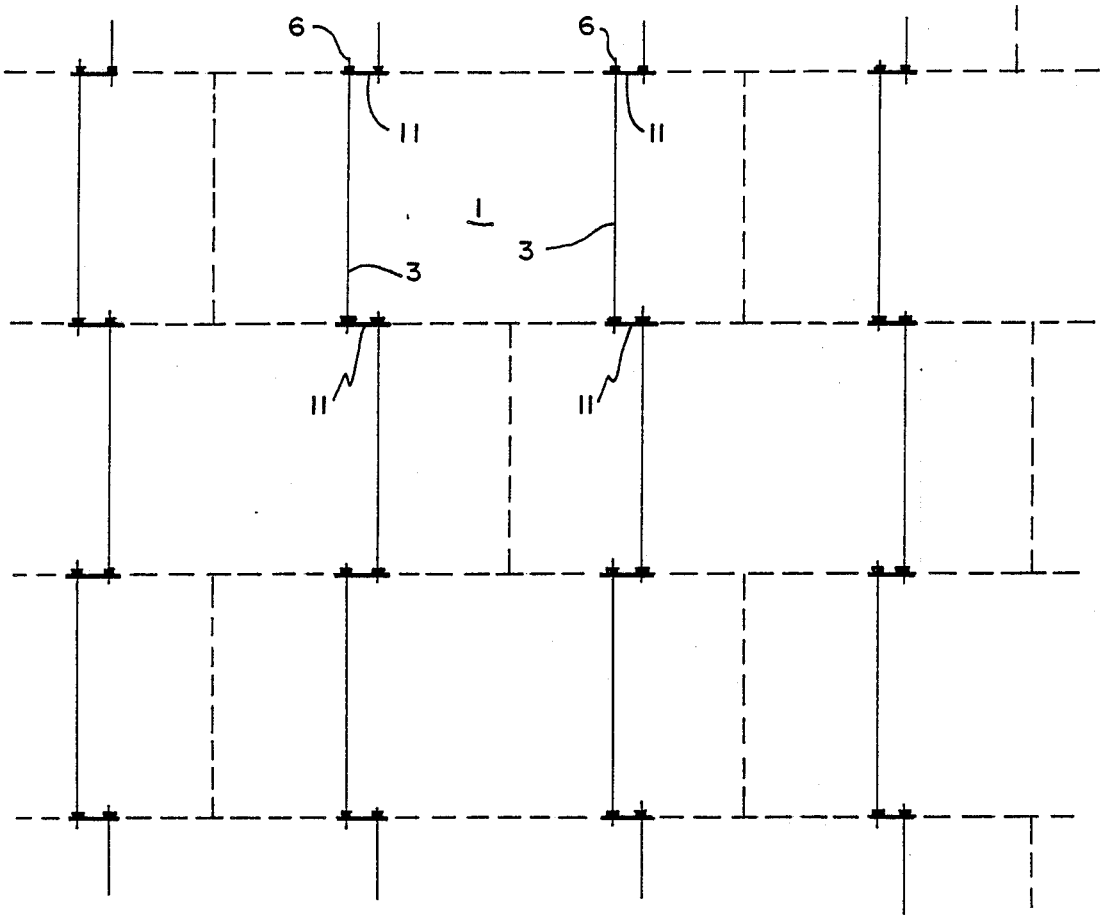
FIG. 3 is a schematic view of the arrangement of the lining elements in accordance with the invention, seen from the interior of the furnace in a perpendicular direction to the interior furnace wall.

FIG. 3 is a schematic representation of the arrangement of the elements 1 by means of the supporting means 11 and the supporting elements 3 to form the lining layer closest to the interior of the furnace. Each element is mounted between two pairs of supporting means consisting of adjacent supporting means 11. The pairs of supporting means form rows of supporting means in the direction of the plane of the fibrous plates 2 for fastening elements 1 one beside the other and in the direction perpendicular to the plane of the plates 2 they form lines of supporting means for fastening elements one after the other. Each supporting means 11 comprises two openings 12 side by side, as shown in FIG. 4. The openings are provided in order to fasten the elements in succession in the direction of the supporting elements 3. The elements in succession are disposed so, that the corresponding supporting elements 3 in the succeeding elements do not become attached to a common supporting means 11, but such that the elements will become shifted sideways in with respect to each other, in which case the seams between the elements located beside each other do not extend along the whole length of the structure.

The element of FIG. 1 has two supporting elements with respective fastening means, for fastening the element to four supporting means 11. The supporting elements 3 can be located in a spaced relationship of, for example at 30 cm intervals and a single element can comprise more than two of them, in which case broader elements can be used. The number of seams can be minimized in this way. The dimensioning of the elements as well as the intervals of the points of attachment can naturally be altered in accordance with the specific use. It is most appropriate, though, that the elements are available in standard sizes, which makes their installation work easy and quick.

During installation work the elements can be also shaped so, that they may better comply with the location of installation. In addition to elements of standard sizes, there may also be a need for elements, whose width (dimension in the plane of the supporting elements in the direction perpendicular to the supporting elements) must be dimensioned according to the location in particular at the edge of the lining structure. The same applies to the length of the elements (dimension in the direction of the supporting elements). The elements needed at these locations can be made separately, for example, at the installation site in order to comply with the location of installation, or they can be made of standard elements by cutting away the insulating material. A standard element with two or more supporting elements and with a width at least equal to or greater than the length is suitable for the practical "basic element" for this purpose.

The lining layer 13 is mounted at its place before the elements 1 are mounted. The layer 13*a* can be held at its place by means of stop pins inserted in a hole 16 of the supporting means 11 (FIG. 4). The layer 13*b* can also be held at its place by stopping means, which are inserted in the openings 12 and which fall out or are broken when the layer 13*b* is pressed towards the wall 10 by means of the element in the course of installation work.

For making it easier to guide the element as it is mounting at its place, the projections of the fastening means are provided with an extension 15, which extends from the stopping means 7 towards the free end of the projection on that side which will be inserted against a preceding element. The extension holds for its part the backing materials at their places by penetrating between the preceding element 1 and the layer 13 located on the side of the interior wall, as shown in FIG. 2.

Figure 5A:
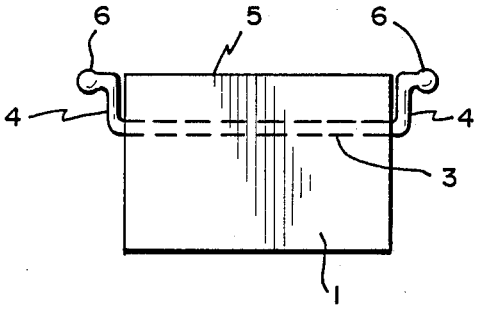
FIGS. 5*a* and 5*b* are views of some alternative embodiments of the elements.
Figure 5B:
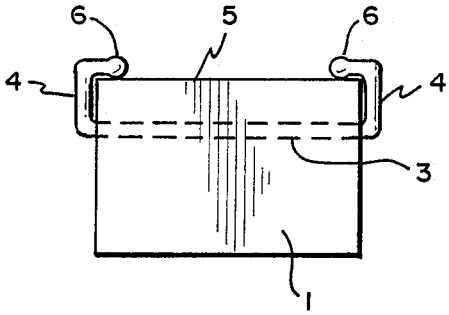

FIGS. 5*a* and 5*b* show some alternative embodiments of the fastening element. In these the projections 6 of the opposite ends of the supporting element 3 are not directed towards the same direction from the fastening means 4, as in FIG. 4, but their free ends are directed towards opposite directions, in FIG. 5*a* away from each other and in FIG. 5*b* towards each other. Because the bent metal rod constituted of the supporting element 3 and the fastening means 4 has some flexibility, the projections of these elements can also be mounted into the supporting means by bending the means 4. Moreover, the elements shown in FIGS. 5*a* and 5*b* are particularly suitable as last elements in the furnace ceiling or in the side wall edge area.

Figure 6:
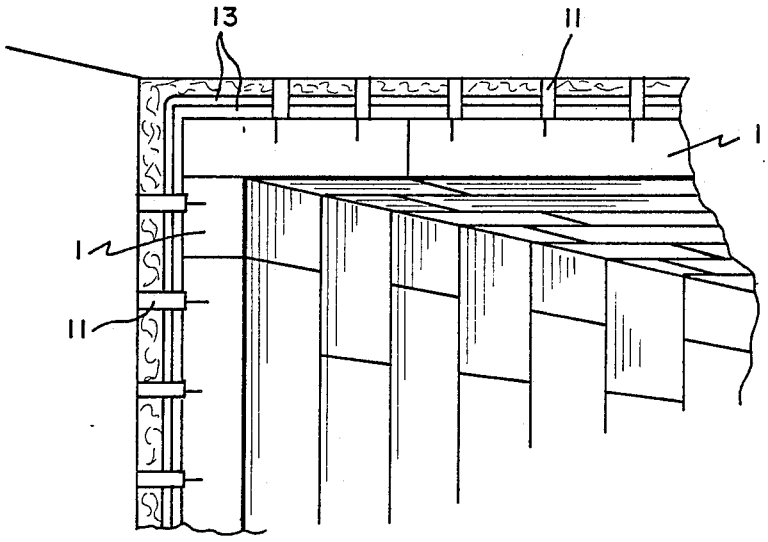
FIGS. 6 and 7 illustrate the lining structure at the location of a furnace corner and a furnace door.
Figure 7:
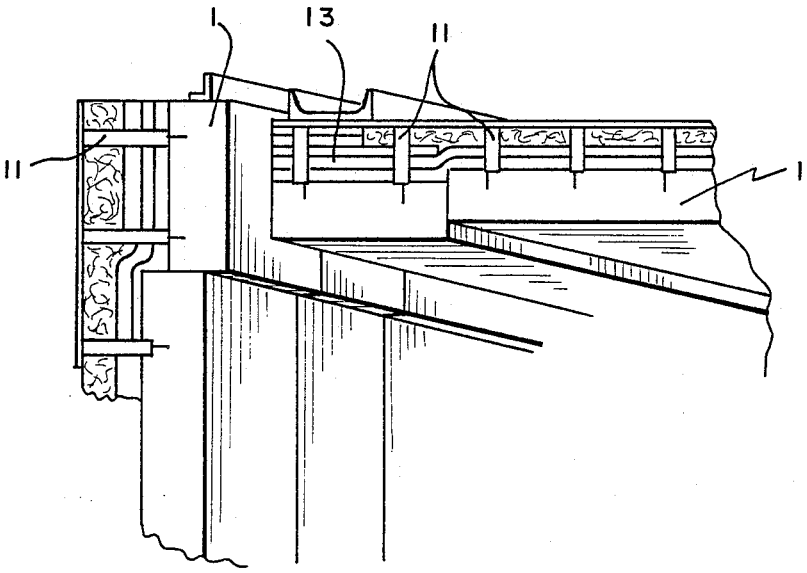

FIGS. 6 and 7 illustrate, how the system of the elements can be utilized in the corner of the furnace (FIG. 6) and at the location of the door (FIG. 7). The supporting means 11 on both walls (in FIG. 6 on the walls on both sides of the corner and in FIG. 7 on one hand on the wall of the furnace and on the other hand on the wall of the door) are welded in alignment with parallel lines, which are formed by the means along the direction of the supporting elements 3. Consequently, the flanks (the sides perpendicular to the end sides and the inner surface 5 of the element) of the elements in the one wall will lie against the outer surface (the surface on the opposite side in relation to the inner surface 5) of the elements in the other wall, this being the case both in the corner and at the location, where the furnace and the door meet. FIG. 6 shows, how in the meeting area alternate elements 1 along the longitudinal direction of the supporting elements 3 are narrower, for example supported by only one single supporting element 3, in order to make it possible to realize the arrangement illustrated in FIG. 3 also at the edge area of the lining structure. FIG. 7 illustrates, how in the meeting area of the door and the wall (the sc-called abutting face) the lining layer can be made thicker at the edge of both the door and the wall. The thickness is in this case increased primarily by increasing the thickness of the layers 13 lying against the interior wall of the furnace and the lining elements 1 have the same thickness as elsewhere. Consequently, the supporting means 11 have in this case greater length. A lining layer of greater thickness can of course be accomplished by using thicker lining elements 1.

The advantages of the invention are simplicity of installation work as well as convenience in detachment of elements in case or repair work. This is not possible when screws and like fastening means are used during installation work of elements. Moreover, the structure formed by the supporting element 3, the fastening means 4 and the projections 6 makes it possible for the elements to take their positions tightly but at the same time flexibly and no seams will be present. For example, the projections 6 are able to rotate about their longitudinal direction in the openings 12 while the support element 3 rotates within the lining material, thus allowing the element 1 to be slightly shifted sideways in order to find the best position.

The lining material of the element can consist of ceramic fibers, which can resist temperatures as high as 1300°-1500° C. The fastening element formed by the supporting element 3, the fastening means 4 and the projections 6 is preferably formed by bending from one single rod of heat resistant steel, in which the stopping means 7 have been formed prior to bending. The stopping means 7 can be formed also by forming a notch or notches in the rod at the projection 6, these notches constituting the narrower portion 8 fitting into the notch 12*b*. The details of the element as well as the lining structure according to the invention can be varied also in other respects within the inventional scope presented by the claims, for example also other kind of shaping of the support means 11 and the projections 6 makes functions corresponding to those presented hereinabove possible.

I claim:

1. Lining element for heat treatment furnaces, comprising lining material consisting of insulating material, an elongate supporting element for transversely piercing the lining material, elongate fastening means for attachment of the element to the interior furnace wall provided at both ends of the supporting element, the free ends of the fastening means being provided with projections extending transversely to the longitudinal direction of the fastening means at the height of a planar interior surface of the element, which surface will be closest to the interior furnace wall.

2. Lining element in accordance with claim 1, wherein the projections at the ends of the fastening means comprise a stopping means and a portion between the fastening means and the stopping means having a dimension smaller than the corresponding dimension of the stopping means, at least in a direction perpendicular to the longitudinal direction of the projection.

3. Lining element in accordance with claim 1, wherein the fastening means extend parallel to each other.

4. Lining element in accordance with claim 1, wherein the fastening means are formed by bending the ends of the supporting element extending outwardly of the lining material into a position where they extend substantially parallely to the end surfaces of the lining element.

5. Lining structure in accordance with claim 1, wherein the fastening means are formed by bending the ends of the supporting element extending outwardly of the lining material into a position where they extend substantially parallel to the end surfaces of the lining element.

6. Lining structure in accordance with claim 2, wherein the fastening means are formed by bending the ends of the supporting element extending outwardly of the lining material into a position where they extend substantially parallel to the end surfaces of the lining element.

7. Lining structure in accordance with claim 3, wherein the fastening means ar formed by bending the ends of the supporting element extending outwardly of the lining material into a position where they extend substantially parallel to the end surfaces of the lining element.

8. Lining structure in accordance with claim 4, wherein the fastening means are formed by bending the ends of the supporting element extending outwardly of the lining material into a position where they extend substantially parallel to the end surfaces of the lining element.

9. Lining structure for heat treatment furnaces, comprising:

a lining layer closest to the interior wall of the furnace, lining elements including lining material consisting of insulating material, and supporting means projecting out of the interior wall of a furnace for attachment of the lining elements thereto by means of supporting elements transversely piercing the lining material, both ends of the supporting elements being provided with a fastening means extending transversely to the longitudinal direction of the supporting element and each having at its free end a projection, which is insertable into means provided in the supporting means substantially in the direction of the interior wall of the furnace, the means being in engagement with the projections and preventing the element from being shifted away from the interior wall of the furnace thus locking it at its height of the interface between a planar interior surface of the lining element and the lining layer closest to the interior wall of the furnace.

10. Lining structure in accordance with claim 9, wherein the supporting means is a plate-like piece having an opening, into which the projection at the end of the fastening means is inserted substantially in the direction of the interior wall of the furnace.

11. Lining structure in accordance with claim 10, wherein the projection comprises a stopping means, and a portion between the joining point of the projection and the fastening means and of the stopping means, the portion having a dimension smaller than the corresponding dimension of the stopping means at least in a direction perpendicular to the longitudinal direction of the projection, and wherein the opening in the supporting means comprises a portion, whose corresponding dimension is smaller than the dimension of the stopping means, locking in engagement with the portion of the projection into its position.

12. Lining structure in accordance with claim 10, wherein the support means comprise two openings positioned side by side and being at a substantially equal distance from the interior wall of the furnace.

* * * * *